US008345894B2

(12) United States Patent
Akino

(10) Patent No.: US 8,345,894 B2
(45) Date of Patent: Jan. 1, 2013

(54) IMPEDANCE CONVERTER FOR MICROPHONE AND MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 330 days.

(21) Appl. No.: 12/779,077

(22) Filed: May 13, 2010

(65) Prior Publication Data

US 2010/0296670 A1 Nov. 25, 2010

(30) Foreign Application Priority Data

May 22, 2009 (JP) ..... 2009-124206

(51) Int. Cl.
*H04R 3/00* (2006.01)

(52) U.S. Cl. ..... 381/113; 381/319; 381/69.1

(58) Field of Classification Search ..... 381/111, 381/136, 319; 330/3, 118, 150
See application file for complete search history.

(56) References Cited

U.S. PATENT DOCUMENTS

| | | | | |
|---|---|---|---|---|
| 5,727,069 | A * | 3/1998 | Hughes et al. | 381/61 |
| 6,140,870 | A * | 10/2000 | Cook | 330/3 |
| 6,353,324 | B1 * | 3/2002 | Uber et al. | 324/457 |
| 6,453,048 | B1 | 9/2002 | Akino | |
| 2004/0090263 | A1 * | 5/2004 | Harner | 330/3 |

* cited by examiner

*Primary Examiner* — Fan Tsang
*Assistant Examiner* — Eugene Zhao
(74) *Attorney, Agent, or Firm* — Whitham Curtis Christofferson & Cook, PC

(57) ABSTRACT

Vacuum tubes that receive output signals from microphone units through grids and with which the signals are output as outputs from cathode followers; FETs in cascade connection with the corresponding vacuum tubes and that define currents flowing in the vacuum tubes; and bias circuits that apply a bias voltage to the grids of the corresponding vacuum tubes are included. Pairs of such vacuum tubes, FETs, and fixed bias circuits are each symmetrically connected so that a balanced signal can be output from two cathode followers, and an adjuster is provided between the pair of fixed bias circuits, the adjuster adjusts currents flowing in the pair of vacuum tubes to achieve a balanced output.

18 Claims, 3 Drawing Sheets

IMPEDANCE CONVERTER FOR MICROPHONE AND MICROPHONE

BACKGROUND OF THE INVENTION

1. Field of the Invention

The present invention relates to an impedance converter for a microphone and a microphone. More specifically, the present invention relates to an impedance converter for a microphone and a microphone using a vacuum tube as an impedance converting element in which current flowing in a vacuum tube is controlled with a semiconductor device that performs constant current operation to enable an adjustment to achieve a balanced output.

2. Description of the Related Art

Capacitor microphones have small effective capacitance and high output impedance. Thus, for an output signal therefrom, high input impedance is required to assure frequency response at a low frequency band. Upon feeding an output signal from a capacitor microphone to an amplifier through a cable and the like, the output impedance of the capacitor microphone needs to be lowered. Therefore, capacitor microphones incorporate an impedance converter having high input impedance and low output impedance. A field-effect transistor (FET) is widely used as an impedance conversion element incorporated in a capacitor microphone.

A capacitor microphone is known that uses a vacuum tube as an impedance conversion element for higher sound quality and maximum output level (see, for example U.S. Pat. No. 6,453,048). U.S. Pat. No. 6,453,048 discloses, as an embodiment of the invention, an impedance converter including: a grounded plate amplifier tube; and a bias circuit that generates a bias voltage to be applied to the grid of the amplifier tube. The bias circuit includes: a first diode that applies a bias voltage to the grid of the amplifier tube so that a current flows to the grid; a second diode in inverse parallel connection with the first diode; and a third diode provided between the cathode of the amplifier tube and a load resistance so that a current flows from the cathode of the amplifier tube to the load resistance. With a plate current flowing in the amplifier tube, a voltage generated in the third diode is applied to the grid of the amplifier tube as a bias voltage via the first or the second diodes.

By feeding a sound signal as a result of conversion by a capacitor microphone unit to the grid of the amplifier tube, an output signal from the capacitor microphone having high input impedance can be output as a low output impedance sound signal.

The impedance converter disclosed in U.S. Pat. No. 6,453,048 outputs a signal with a triode vacuum tube in cathode follower connection because a cathode follower has high input impedance and low output impedance, and thus an increase in maximum output level can be achieved therewith.

Generally, a sound signal from a microphone is output as a balanced signal consisting of outputs from a hot side and a cold side to prevent noise attributable to an electric field or a magnetic field applied to an output transmission line of the microphone from being generated in the sound signal. To produce a balanced signal, impedances at the hot side and the cold side are required to be identical. Accordingly, an output transformer is widely used having a secondary coil with a center tap at the output circuit of the microphone to make the output impedances at the hot side and the cold side identical. Unfortunately, a transformer in an output circuit changes a tone of sound and thus may not be preferred by a user. Therefore, a microphone is available that has a circuit configuration requiring no output transformer. A conventional impedance converter used in a microphone requiring no output transformer is exemplary described below with reference to FIG. 3.

FIG. 3 illustrates microphone units 11 and 12 that each includes a diaphragm vibrated by sound pressure, and a fixed electrode facing the diaphragm with a certain space therebetween. The diaphragm of each of the microphone units 11 and 12 is connected to the ground (GRD: hereinafter referred to as the "earth"). The fixed electrode of the microphone unit 11 is connected the grid of a first vacuum tube 21 via a capacitor 15, while the fixed electrode of the microphone unit 12 is connected to the grid of a second vacuum tube 22 via a capacitor 25. In this example, the two microphone units 11 and 12 are incorporated in a single unit casing in a back-to-back manner to form a directionality variable unit. The two vacuum tubes 21 and 22 are used as impedance converters, are triodes, and are incorporated in a single glass tube to form a multiple unit tube.

A certain direct voltage needs to be applied between the diaphragm and the fixed electrode of each of the microphone units 11 and 12. In the example illustrated in FIG. 3: a negative voltage is applied to the fixed electrode of the microphone unit 11 from a direct power source 19 via a resistor 20, and diodes 13 and 14 in inverse parallel connection; while a positive voltage is applied to the fixed electrode of the microphone unit 12 from a direct power source 29 via a resistor 30, and diodes 23 and 24 in inverse parallel connection. A high direct power-supply voltage (e.g., 120 V) is applied to the plate of each of the vacuum tubes 21 and 22 from a power supply terminal 5. Via a direct voltage input terminal 4 which is a terminal in connection with the outside a power supply of 6.3 V for heating a heater 51 for the vacuum tubes 21 and 22 is supplied.

A bias circuit of each of the vacuum tubes 21 and 22 is connected as follows for cathode follower output. The cathodes of the vacuum tubes 21 and 22 are earthed via resistors 42 and 44, respectively. The cathode of the vacuum tube 21 is connected to a cold-side output terminal 3 via an electrolytic capacitor 47, while the cathode of the vacuum tube 22 is connected to a hot-side output terminal 2 via an electrolytic capacitor 48 so that a balanced output can be obtained with terminal voltages of the resistors 42 and 44. The high power-supply voltage is divided by dividing resistors 37 and 52 connected in series. In this circuit, the divided voltage is applied to the grid of the vacuum tube 21 via a resistor 38 and further via diodes 17 and 18 in inverse parallel connection. Similarly, the divided voltage is applied to the grid of the vacuum tube 22 via a resistor 39 and further via diodes 27 and 28 in inverse parallel connection. The dividing resistor 52 and the electrolytic capacitor 53 are connected in parallel. Ends of the diodes 13 and 14 in parallel connection and the diodes 17 and 18 in parallel connection are connected in parallel via coupling capacitors 15 and 16. Similarly, ends of the diodes 23 and 24 in parallel connection and the diodes 27 and 28 in parallel connection are connected in parallel via coupling capacitors 25 and 26. An electrolytic capacitor 45 is connected between a connection point between the diodes 17 and 18 and the resistor 38, and the cathode of the vacuum tube 21, while an electrolytic capacitor 46 is connected between a connection point between the diodes 27 and 28 and the resistor 39, and the cathode of the vacuum tube 22. A resistor 49 is connected between the output terminal 3 and the earth, while a resistor 50 is connected between the output terminal 2 and the earth.

As described above, or as clearly illustrated in FIG. 3, the two microphone units 11 and 12 are connected to their impedance converting elements, i.e., the vacuum tubes 21 and 22, respectively in a symmetrical manner. The bias circuit of the vacuum tube 21 includes the first diode 17 that applies a bias voltage to the grid of the corresponding vacuum tube, and the second diode 18 in inverse parallel connection with the first diode 17. The bias circuit of the vacuum tube 22 includes the first diode 27 that applies a bias voltage to the grid of the corresponding vacuum tube, and the second diode 28 in inverse parallel connection with the first diode 27. From the cathodes of the vacuum tube 21 and 22, cold side and hot side signals having opposite phases are output, respectively to achieve a balanced output. With the capacitors 15 and 16 connected on the vacuum tube 21 side, and the capacitors 25 and 26 connected on the vacuum tube 22 side, direct voltages applied to the microphone units 11 and 12 are separated from sound signals as a result of conversions by the microphone units 11 and 12. Thus, only the sound signal is fed to each of the grids of the vacuum tubes 21 and 22.

In the conventional capacitor microphone units and the impedance converters therefor shown in FIG. 3, even if the same bias voltages are applied to the two vacuum tubes 21 and 22, currents flowing in the vacuum tubes 21 and 22 are different. Obviously, variable characteristics of the two vacuum tubes lead to difference in currents. However, the currents are different even if the two vacuum tubes have stable characteristics. If the currents of the vacuum tubes 21 and 22 are different, impedances of output circuits in cathode follower connection therewith are different, resulting in an unbalanced output. Thus, if an electric field or a magnetic field is applied to the output circuit or the microphone cable, noise mixes with a sound signal.

Further, for a cathode follower output, a cathode potential must be controlled because potential difference between the cathodes of the vacuum tubes 21 and 22 and a heater tends to be large to cause insulation failure between the cathodes and the heater leading to production of noise.

The problems of a conventional capacitor microphone unit have been described. Also in the case where a ribbon microphone unit is used, a problem arises. More specifically, ribbon microphone units have extremely low output signals and thus, the output therefrom is generally boosted with a step-up transformer with an extremely large turns ratio of, for example, 1:180. Unfortunately, such a transformer with a large turns ratio makes an output impedance too high, e.g., 13 kΩ. The output impedance may be lowered with the impedance converting circuit as shown in FIG. 3, but there are the technical problems as described above.

SUMMARY OF THE INVENTION

An object of the present invention is to solve the technical problems in the conventional technique. More specifically, an object of the present invention is to provide an impedance converter for a microphone and a microphone using a vacuum tube as an impedance converting element, with which difference between currents flowing in the two vacuum tubes provided for a balanced output can be eliminated, and the currents are adjustable to make the impedances in the balanced output the same to prevent noise from entering an output signal transmission path.

An impedance converter for a microphone according to an aspect of the present invention includes: a vacuum tube that receives an output signal from a microphone unit through a grid and with which the signal is output as an output from a cathode follower; an FET in cascade connection with the vacuum tube and that defines a current flowing in the vacuum tube; and a bias circuit that applies a bias voltage to the grid of the vacuum tube. Pairs of such vacuum tubes, FETs, and fixed bias circuits are each symmetrically connected so that a balanced signal is output from two cathode followers. An adjuster is provided between the pair of fixed bias circuits. The adjuster adjusts currents flowing in the pair of vacuum tubes to achieve a balanced output.

An impedance converter for a microphone according to another aspect of the present invention includes: a vacuum tube that receives an output signal from a microphone unit through a grid and with which the signal is output as an output from a cathode follower; an FET in cascade connection with the vacuum tube and that defines a current flowing in the vacuum tube; and a bias circuit that applies a bias voltage to the grid of the vacuum tube. The bias circuit includes: a first diode and a second diode that apply the bias voltage to the grid of the vacuum tube, the first diode and the second diode being in inverse parallel connection; and a bias resistor for applying the bias voltage at a constant level to the grid of the vacuum tube via the first diode or the second diode. Pairs of such vacuum tubes, FETs, and fixed bias circuits are each symmetrically connected so that a balanced signal is output from two cathode followers. An adjuster is provided between the pair of fixed bias circuits. The adjuster adjusts currents flowing in the pair of vacuum tubes to achieve a balanced output.

A microphone according to an aspect of the present invention includes: a microphone unit that outputs two signals each having a phase opposite to that of the other; and an impedance converter that receives the signals from the microphone units, and has a high input impedance and a low output impedance. The impedance converter is an impedance converter configured as above.

EFFECT OF THE INVENTION

In the impedance converter for a microphone and the microphone, the vacuum tube as the impedance conversion element and the FET are in cascade connection. Thus, the FET can serve as a constant current diode and the stable plate current of the vacuum tube can be obtained. In addition, with the pairs of such vacuum tubes, FETs, and fixed bias circuits in symmetrical connection, a balanced output can be obtained from two cathode followers, and the adjuster that adjusts current flowing in each of the pair of the vacuum tubes to achieve a balanced output is provided between the pair of fixed bias circuits. Therefore, impedances at two sides for the balanced output can be identical to prevent noise form entering the output signal transmission path.

DETAILED DESCRIPTION OF THE PREFERRED EMBODIMENTS

Figure 3:
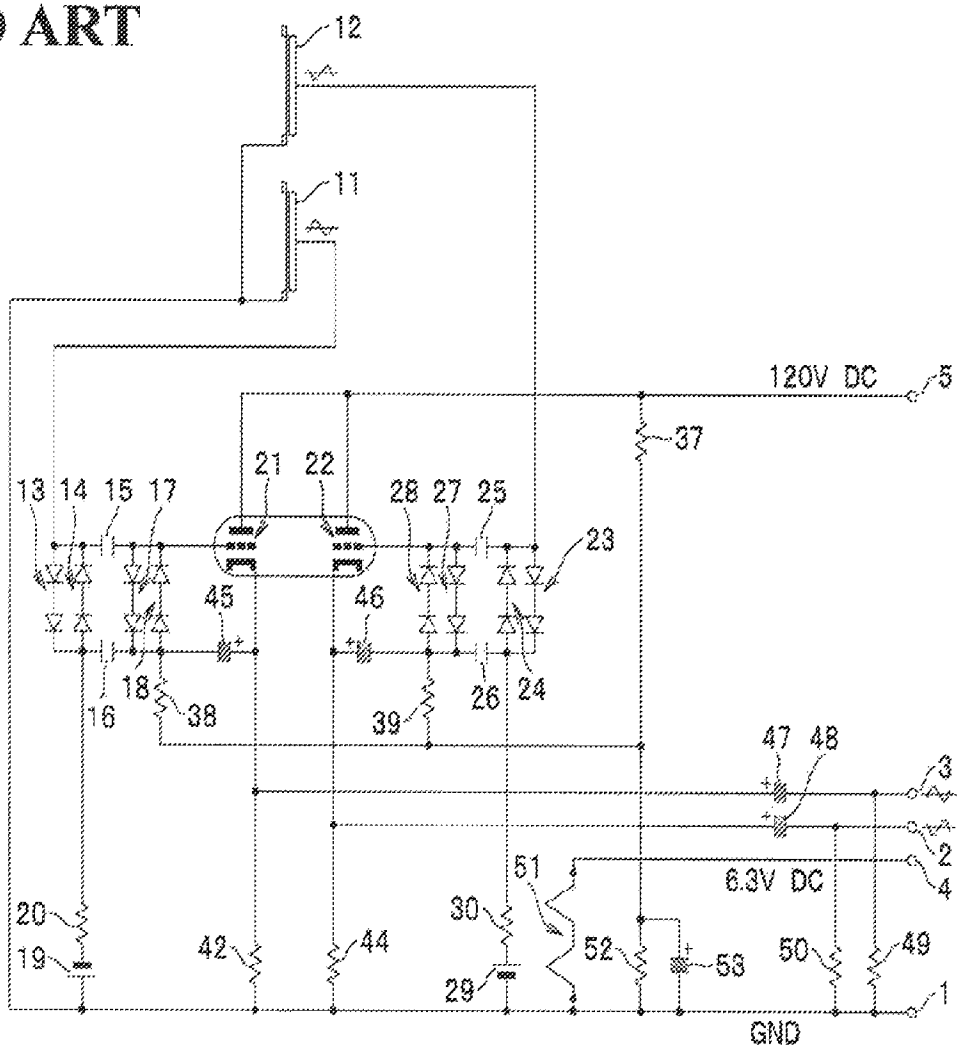
FIG. 3 RELATED ART
FIG. 3 is an exemplary circuit diagram of a conventional impedance converter for a microphone and a conventional microphone.

Embodiments of an impedance converter for a microphone and a microphone according to the present invention are described below with reference to the drawings. Circuit components substantially similar to those shown in FIG. 3 are given the same reference numerals.

First Embodiment

Figure 1:
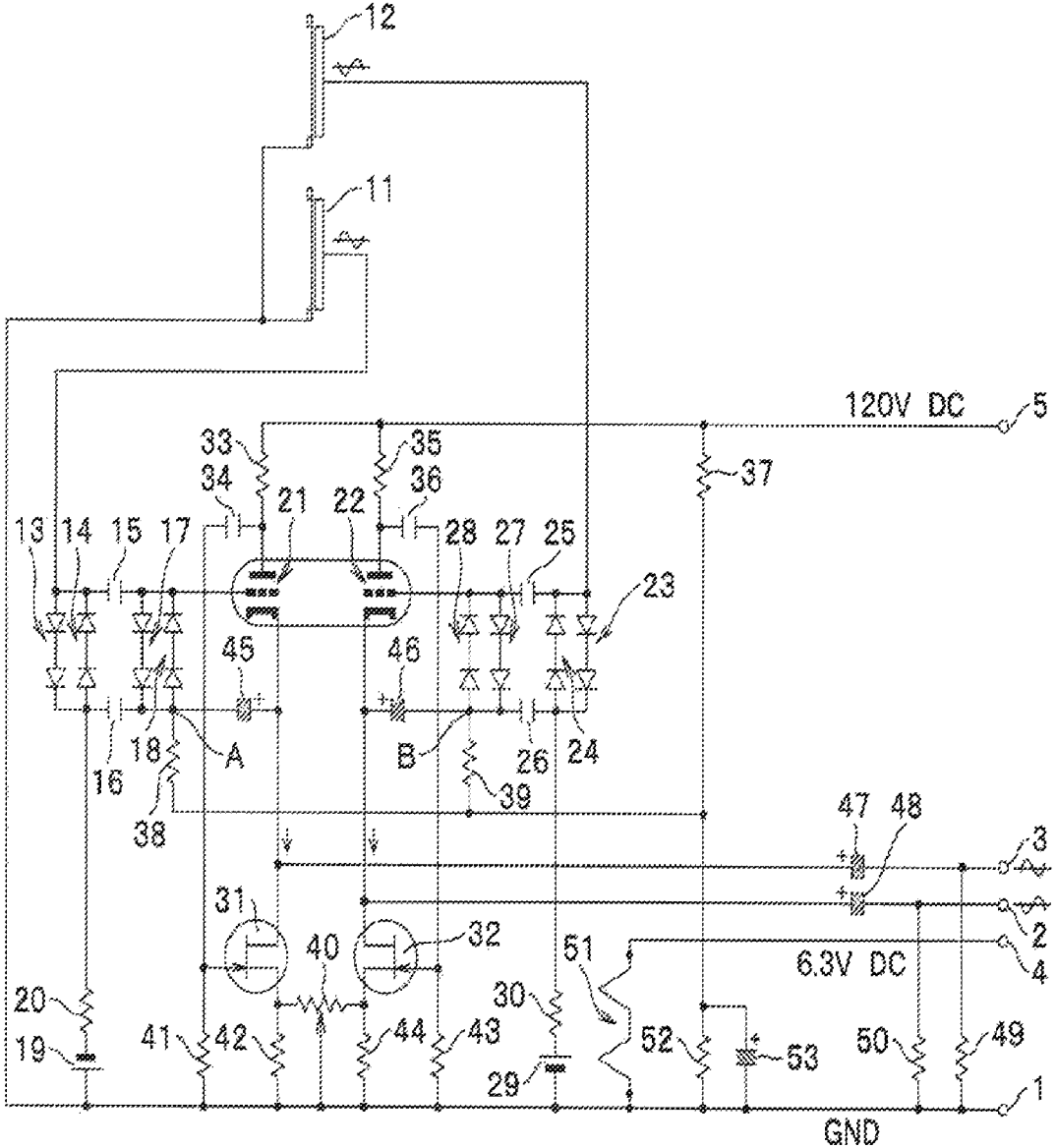
FIG. 1 is a circuit diagram of an embodiment of an impedance converter for a microphone and a microphone according to the present invention.

In FIG. 1, the numerals 11 and 12 indicate capacitor microphone units. The microphone units 11 and 12 that each include a diaphragm vibrated by sound pressure, and a fixed electrode facing the diaphragm with a certain space therebetween. The diaphragms of both microphone units 11 and 12 are earth grounded. The fixed electrode of the microphone unit 11 is connected to the grid of a first vacuum tube 21 via a coupling capacitor 15, while the fixed electrode of the microphone unit 12 is connected to the grid of a second vacuum tube 22 via a coupling capacitor 25. Therefore, an output signal from the microphone unit 11 is fed to the grid of the vacuum tube 21 via the coupling capacitor 15, while an output signal from the microphone unit 12 is fed to the grid of the vacuum tube 22 via the coupling capacitor 25. The two microphone units 11 and 12 may be incorporated in a single unit casing in a back-to-back manner to form a directionality variable unit. Alternatively, the two microphone units 11 and 12 may be integrally connected in a back-to-back manner. The two vacuum tubes 21 and 22 are used as impedance converters, are triodes, and are incorporated in a single glass tube to form a multiple unit tube. A direct high voltage of, for example 120 V, is applied to the plate of the vacuum tube 21 from a high voltage power supply input terminal 5 via a resistor 33, and to the plate of the vacuum tube 22 from the terminal 5 via a resistor 35.

The vacuum tube 21 is connected for a cathode follower output and is in cascade connection with an FET 31. More specifically, the cathode of the vacuum tube 21 is connected to the drain of the FET 31, while the source of the FET 31 is connected to the earth via a resistor 42 for controlling a plate current of the vacuum tube 21. A capacitor 34 is connected between the plate of the vacuum tube 21 and the base of the FET 31. A resistor 41 is connected between the base of the FET 31 and the earth. An impedance converted output signal from the cathode of the vacuum tube 21 is sent outside from a cold-side output terminal 3 via an electrolytic capacitor 47.

A bias circuit described below applies a bias voltage to the grid of the vacuum tube 21. The direct high voltage supplied from the terminal 5 is divided by dividing resistors 37 and 52 connected in series between the terminal 5 and the earth. The dividing point between the resistors 37 and 52 is connected to the grid of the vacuum tube 21 via a bias resistor 38 and diodes 17 and 18. The diodes 17 and 18 are in inverse parallel connection and are each formed of two diodes connected in series. The cathode of the diode 17 and the anode of the diode 18 are connected to the resistor 38, while the anode of the diode 17 and the cathode of the diode 18 are connected to the grid of the vacuum tube 21. An electrolytic capacitor 45 is connected between the cathode of the vacuum tube 21 and a point A which is a connection point between the resistor 38 and the diodes 17 and 18. Below, the diodes 17 and 18 are referred to as a first and a second diode, respectively. A voltage at the dividing point of the dividing resistors 37 and 52 is applied to the grid of the vacuum tube 21 via the bias resistor 38 and the first or the second diode 17 or 18. An electrolytic capacitor 53 is in parallel connection with the dividing resistor 52.

A direct voltage is applied to the fixed electrode of the microphone unit 11 from a direct voltage supply 19 via the resistor 20 and the diodes 13 and 14 in inverse parallel connection. The diodes 13 and 14 are in parallel connection with the first and the second diodes 17 and 18 with the coupling capacitors 15 and 16 in between. The diodes 13 and 14 supply a direct voltage from the direct voltage supply 19 to the fixed electrode of the microphone unit 11. The coupling capacitors 15 and 16 separate the direct voltage from an output signal from the microphone unit 11 so that only the output signal from the microphone unit 11 is fed to the grid of the vacuum tube 21. The diodes 13 and 14 are each formed of two elements connected in series like the first and the second diodes 17 and 18 as described above. The number of elements forming each of the diodes can be arbitrarily set and can be, for example, one. An increase in the number of diodes forming each of the diodes increases a bias voltage to be applied to the grid of the vacuum tube 21.

A circuit structure with the vacuum tube 22 as the main element is as same as the circuit structure with the vacuum tube 21 as the main element described above, thereby forming a symmetrical structure on the circuit diagram. The circuit structure with the vacuum tube 22 as the main element will be described below.

The vacuum tube 22 is connected for a cathode follower output and is in cascade connection with an FET 32. More specifically, the cathode of the vacuum tube 22 is connected to the drain of the FET 32, while the source of the FET 32 is connected to the earth via a resistor 44 for controlling a plate current of the vacuum tube 22. A capacitor 36 is connected between the plate of the vacuum tube 22 and the base of the FET 32. A resistor 43 is connected between the base of the FET 32 and the earth. An impedance converted output signal from the cathode of the vacuum tube 22 is sent outside from a hot-side output terminal 2 via an electrolytic capacitor 48.

A bias circuit described below applies a bias voltage to the grid of the vacuum tube 22. The dividing point between the dividing resistors 37 and 52 connected in series is connected to the grid of the vacuum tube 22 via a bias resistor 39 and diodes 27 and 28. The diodes 27 and 28 are in inverse parallel connection and are each formed of two diodes connected in series. The cathode of the diode 27 and the anode of the diode 28 are connected to the resistor 39, while the anode of the diode 27 and the cathode of the diode 28 are connected to the grid of the vacuum tube 22. An electrolytic capacitor 46 is connected between the cathode of the vacuum tube 22 and a point B which is a connection point between the resistor 39 and the diodes 27 and 28. Below, the diodes 27 and 28 are referred to as a first and a second diode, respectively. A voltage at the dividing point of the dividing resistors 37 and 52 is applied to the grid of the vacuum tube 22 via the bias resistor 39 and the first or the second diode 27 or 28.

A direct voltage is applied to the fixed electrode of the microphone Unit 12 from a direct voltage supply 29 via the resistor 30 and the diodes 23 and 24 in inverse parallel connection. The diodes 23 and 24 are in parallel connection with the first and the second diodes 27 and 28 with the coupling capacitors 25 and 26 in between. The diodes 23 and 24 supply a direct voltage from the direct voltage supply 29 to the fixed electrode of the microphone unit 12. The coupling capacitors 25 and 26 separate the direct voltage from an output signal from the microphone unit 12 so that only the output signal from the microphone unit 12 is fed to the grid of the vacuum tube 22. The diodes 23 and 24 are each formed of two elements connected in series like the first and the second diodes 27 and 28 as described above. The number of elements forming each of the diodes can be arbitrarily set and can be, for example, one. An increase in the number of diodes forming each of the diodes increases a bias voltage to be applied to the grid of the vacuum tube 22.

As described above, in the embodiment illustrated in FIG. 1, with pairs of the vacuum tubes, the FETs, and the fixed electrodes symmetrically connected, a balanced output is obtained with two cathode followers. The main feature of the present embodiment is that, between the pair of the fixed bias circuits, a variable resistor 40 is provided that serves as an adjuster that adjusts the currents flowing in the pair of the vacuum tubes 21 and 22 to achieve a balanced output. More specifically, fixed terminals at both ends of the variable resistor 40 are connected between the sources of the FETs 31 and 32. A variable terminal of the variable resistor 40 is connected to the earth. The same current flows in the vacuum tube 21 and in the FET 31 and the same current flows in the vacuum tube 22 and in the FET 32. The currents are controlled with plate current controlling resistors 42 and 44 and the adjusting position of the variable resistor 40. The variable resistor 40 can be adjusted to: increase the current of the vacuum tube 21 to decrease the current of the vacuum tube 22; or decrease the current of the vacuum tube 21 to increase the current of the vacuum tube 22. Thus, the variable resistor 40 is adjusted to equalize the currents of the vacuum tubes 21 and 22. Through such adjustment, impedances at the hot-side and the cold-side from cathode followers become identical to achieve a balanced output and thus, noise is prevented from mixing with an output signal even if an electrical field or a magnetic field is applied to the output signal transmission path due to an external factor. A semi-fixed resistor which semi-fixedly maintains the adjusting position is preferably used as the variable resistor 40.

The impedance converter includes a heater power supply terminal 4 as well as the direct high voltage power supply input terminal 5, the cold-side output terminal 3, the hot-side output terminal 2, and the earth terminal 1. A heater 51 for the vacuum tubes 21 and 22 is connected between the heater power supply terminal 4 and the earth terminal 1.

The earth terminal 1, the hot-side output terminal 2, and the cold-side output terminal 3 can be connected to external devices through a balanced cable connected thereto with a connector and the like. Alternatively, a transformer may be provided that is disposed in, for example, a microphone casing. Here, the output terminals 2 and 3 are connected to the ends of a primary winding of the transformer, respectively. Cold-side and hot-side terminals of the microphone connector are connected to the ends of a secondary winding, respectively. An earth terminal of the microphone connector is connected to the earth terminal 1. Thus, a balanced signal can be output with the hot-side, the cold-side, and the earth terminals of the microphone connector.

In the above described embodiment, output signals from the capacitor microphone units 11 and 12 having high output impedances are fed to the grids of the vacuum tubes 21 and 22 in cathode follower connection and having high input impedances. Due to the cathode follower output of the vacuum tubes 21 and 22, the impedance converter has a low output impedance.

The diodes 17 and 18, and 27 and 28 supply a bias voltage to the vacuum tubes 21 and 22, respectively, in the following manner. Below, a bias voltage generated at each of the connection points A and B is given the reference numeral Vc, and a corresponding grid voltage of each of the vacuum tubes 21 and 22 is given the reference numeral Vd. In the case where the grid voltage Vd has changed to become lower than the bias voltage Vc, due to forward volt-ampere characteristics in the static characteristic of a diode, current flows in the first diode 17 (27), which causes a voltage drop Vf. The grid voltage Vd is lower than the bias voltage Vc for Vf. Thus, the bias voltage Vc becomes small, and the plate current of the vacuum tube 21 (22) increases, resulting in an increase in the bias voltage Vc. This contributes to the compensation of the change in the grid voltage Vd to reduce the current in the diode 17 (27). The operation is repeated until no current flows in the diode 17 (27). As a result, the change in the grid voltage Vd is so compensated that no current flows in the diode 17 (27), therefore, the voltage drop Vf in the diode 17 (27) is zeroed. Thus, the grid voltage Vd becomes equal to the bias voltage Vc.

On the other hand, in the case where the grid voltage Vd has changed to become higher than the bias voltage Vc, the second diode 18 (28) operates in the same way as the above described first diode 17 (27). Thus, the change in the grid voltage Vd is compensated to make the grid voltage Vd equal to the bias voltage Vc. Thus, the grid voltage and the cathode voltage in each of the vacuum tubes 21 and 22 become substantially the same.

Accordingly, the first and the second diodes 17, 18 and 27, 28 operate with almost no potential difference between the terminals with an alternate current and there is no voltage drop therebetween. Thus, substantially the same effect can be obtained as the case where high resistance resistors are provided instead of the diodes 17, 18 and 27, 28.

In other words, the bias circuit of the vacuum tube 21 includes: the first and the second diodes 17 and 27 in inverse parallel connection; and the bias resistor 38, and serves as a fixed bias circuit applying a constant bias voltage to the grid of the vacuum tube 21. The bias circuit of the vacuum tube 22 includes: the first and the second diodes 18 and 28 in inverse parallel connection; and the bias resistor 39, and serves as a fixed bias circuit applying a constant bias voltage to the grid of the vacuum tube 22.

The grid voltage and the cathode voltage of each of the vacuum tubes 21 and 22 are provided by dividing the high power-supply voltage Vb with the voltage dividing resistors 37 and 52. Therefore, the grid voltage and the cathode voltage can be maintained at constant levels, thereby preventing the production of noise attributable to a change in cathode potential.

Further, the plate current controlling resistors 42 and 44 and the variable resistor 40 connected between the sources of the FETs 31 and 32 and the ground define the plate currents of the vacuum tubes 21 and 22. The plate currents of the vacuum tubes 21 and 22 can be controlled to be equal by adjusting the variable resistor 40. Thus, impedances at cold-side and hot-side become identical to achieve a balanced output.

Sound signals from the microphone units 11 and 12 pass through the vacuum tubes 21 and 22, respectively, and thus are free of sound quality degradation. The FETs 31 and 32 are, instead of vacuum tubes, each used as a circuit element that defines the current flowing in the vacuum tubes 21 and 22, and are in cascade connection with the vacuum tubes 21 and 22, respectively. Thus, power consumption for heating the vacuum tube can be reduced while maintaining fine sound quality.

The embodiment illustrated in FIG. 1 includes: the direct power supply 19, the resistor 20, and the diodes 13 and 14, for applying a voltage to the capacitor microphone unit 11; and the direct power supply 29, the resistor 30, and the diodes 23 and 24, for applying a voltage to the capacitor microphone unit 12. Such a voltage applying circuit is not required to configure an electret capacitor microphone.

Second Embodiment

Figure 2:
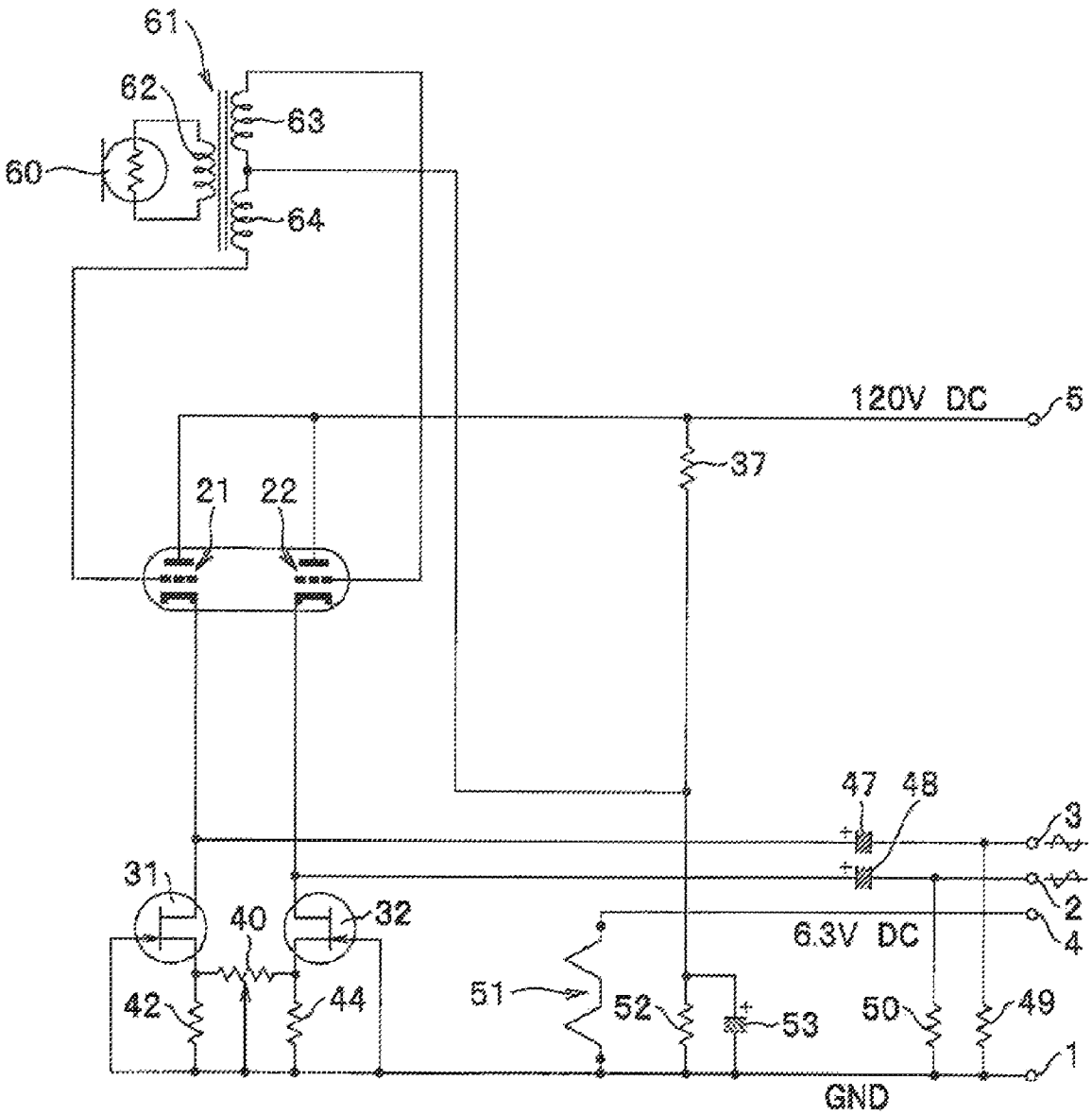
FIG. 2 is a circuit diagram of another embodiment of the impedance converter for a microphone and the microphone according to the present invention.

Another embodiment of the present invention shown in FIG. 2 is described below. Components substantially the same as those of the components in the first embodiment are given the same reference numerals. This embodiment uses a ribbon microphone unit 60 and an output signal therefrom, which is extremely weak, is boosted by a step-up transformer 61 and output. The step-up transformer 61 has: a primary coil 62; secondary coils 63 and 64; and a center tap provided between the secondary coils 63 and 64. As described earlier, the turns ratio between the secondary coils 63 and 64 to the primary coil 62 is extremely large. Output terminals at both ends of the microphone unit 60 are connected to the corresponding terminals of the primary coil 62. The center tap provided between the secondary coils 63 and 64 is connected to the dividing point of the direct high voltage supplied from the terminal 5 and divided by the dividing resistors 37 and 52. Thus, an appropriate voltage is applied to the center tap. Terminals of the secondary coils 63 and 64 are connected to the grids of the vacuum tubes 21 and 22, respectively. Thus, output signals from the microphone unit 60 having opposite phases are fed to the grids of the vacuum tubes 21 and 22. The grids of the vacuum tubes 21 and 22 are applied with a voltage divided by the dividing resistors 37 and 52 via the secondary coils 63 and 64 of the transformer 61, respectively and thus are biased. The vacuum tubes 21 and 22 are triodes and each form a multiple unit tube as in the first embodiment.

A high direct power-supply voltage is applied to the plates of the vacuum tubes 21 and 22 from the terminal 5. The vacuum tubes 21 and 22 are connected for cathode follower output and are in cascade connection with the FETs 31 and 32, respectively. More specifically, the cathode of the vacuum tube 21 is connected to the drain of the FET 31, while the source of the FET 31 is connected to the earth via the plate current controlling resistor 42 of the vacuum tube 21. An impedance converted output signal from the cathode of the vacuum tube 21 is output to the outside from the cold-side output terminal 3 via the electrolytic capacitor 47. Similarly, the cathode of the vacuum tube 22 is connected to the drain of the FET 32, while the source of the FET 32 is connected to the earth via the plate current controlling resistor 44 of the vacuum tube 22. An impedance converted output signal from the cathode of the vacuum tube 22 is output to the outside from the hot-side output terminal 2 via the electrolytic capacitor 48.

Also in this embodiment, with pairs of the vacuum tubes, the FETs, and the fixed bias circuits symmetrically connected, a balanced output is achieved with two cathode followers like in the first embodiment. Further, the variable resistor 40 is provided between the pair of the fixed bias circuits. The variable resistor 40 serves as an adjuster for adjusting the current flowing in the pair of vacuum tubes 21 and 22 to achieve a balanced output. The fixed terminals at both ends of the variable resistor 40 are connected between the sources of the FET 31 and the FET 32, while the variable terminal of the variable resistor 90 is connected to the earth. The same current flows in the vacuum tube 21 and the FET 31, and the same current flows in the vacuum tube 22 and the FET 32. These currents are defined by the plate current controlling resistors 42 and 44, and the adjusting position of the variable resistor 40. The variable resistor 40 can be adjusted to: increase the current of the vacuum tube 21 to decrease the current of the vacuum tube 22; or decrease the current of the vacuum tube 21 to increase the current of the vacuum tube 22. Thus, the variable resistor 40 is adjusted to equalize the currents of the vacuum tubes 21 and 22. Through such adjustment, impedances at hot-side and cold-side from cathode followers become identical to achieve a balanced output, and thus, noise is prevented from mixing with an output signal even if an electrical field or a magnetic field is applied to the output signal transmission path due to an external factor. The variable resistor 40 may be of a semi-fixed type.

In the second embodiment as shown in FIG. 2, instead of a ribbon microphone unit as described above, a capacitor microphone unit can be used as the microphone unit 60.

A ribbon microphone unit may include two parallelly arranged ribbon diaphragms. In this case, an output signal from the microphone unit may be fed to the impedance converting circuit having the structure as illustrated in FIG. 2 via or not via a step-up transformer.

The impedance converter for a microphone and the microphone according to the present invention can be advantageously used by a sound conscious user thanks to a vacuum tube used as an impedance converting element, and thus have a certain commercial value.

What is claimed is:

1. An impedance converter for a microphone, comprising:

a vacuum tube that receives an output signal from a microphone unit through a grid and with which the signal is output as an output from a cathode follower;

an FET in cascade connection with the vacuum tube and that defines a current flowing in the vacuum tube; and a bias circuit that applies a bias voltage to the grid of the vacuum tube, wherein pairs of such vacuum tubes, FETs, and fixed bias circuits are symmetrically connected so that a balanced signal is output from two cathode followers, and an adjuster is provided between the pair of fixed bias circuits, the adjuster adjusting currents flowing in the pair of vacuum tubes to achieve a balanced output, and the adjuster connects to each of the pairs of FETs.

2. An impedance converter for a microphone, comprising:

a vacuum tube that receives an output signal from a microphone unit through a grid and with which the signal is output as an output from a cathode follower;

an FET in cascade connection with the vacuum tube and that defines a current flowing in the vacuum tube; and a bias circuit that applies a bias voltage to the grid of the vacuum tube, wherein the bias circuit includes a first diode and a second diode that apply the bias voltage to the grid of the vacuum tube, the first diode and the second diode being in inverse parallel connection, and a bias resistor for applying the bias voltage at a constant level to the grid of the vacuum tube via the first diode or the second diode, pairs of such vacuum tubes, FETs, and fixed bias circuits are symmetrically connected so that a balanced signal is output from two cathode followers, and an adjuster is provided between the pair of fixed bias circuits, the adjuster adjusting currents flowing in the pair of vacuum tubes to achieve a balanced output, and the adjuster connects to each of the pairs of FETs.

3. The impedance converter for a microphone according to claim 1, wherein a resistor for controlling a plate current of the vacuum tube is connected to the cascade connection of the vacuum tube and the FET.

4. The impedance converter for a microphone according to claim 1, wherein the bias voltage applied to the grid of the vacuum tube is a voltage of a high voltage direct power supply divided by a dividing resistor.

5. The impedance converter for a microphone according to claim 1, wherein the vacuum tube is a triode.

6. The impedance converter for a microphone according to claim 1, wherein the adjuster is a variable resistor.

7. The impedance converter for a microphone according to claim 6, wherein fixed terminals at both ends of the variable resistor are connected between the pair of fixed bias circuits and a variable terminal of the semi-fixed variable resistor is connected to earth.

8. The impedance converter for a microphone according to claim 2, wherein a resistor for controlling a plate current of the vacuum tube is connected to the cascade connection of the vacuum tube and the FET.

9. The impedance converter for a microphone according to claim 2, wherein the bias voltage applied to the grid of the vacuum tube is a voltage of a high voltage direct power supply divided by a dividing resistor.

10. The impedance converter for a microphone according to claim 2, wherein the vacuum tube is a triode.

11. The impedance converter for a microphone according to claim 2, wherein the adjuster is a variable resistor.

12. The impedance converter for a microphone according to claim 11, wherein fixed terminals at both ends of the variable resistor are connected between the pair of fixed bias circuits and a variable terminal of the semi-fixed variable resistor is connected to earth.

13. A microphone comprising:

a microphone unit that outputs two signals each having a phase opposite to that of the other; and an impedance converter that receives the signals from the microphone unit, and has a high input impedance and a low output impedance, wherein the impedance converter comprising:

a vacuum tube that receives an output signal from a microphone unit through a grid and with which the signal is output as an output from a cathode follower;

an FET in cascade connection with the vacuum tube and that defines a current flowing in the vacuum tube; and a bias circuit that applies a bias voltage to the grid of the vacuum tube, wherein pairs of such vacuum tubes, FETs, and fixed bias circuits are symmetrically connected so that a balanced signal is output from two cathode followers, and an adjuster is provided between the pair of fixed bias circuits, the adjuster adjusting currents flowing in the pair of vacuum tubes to achieve a balanced output, and the adjuster connects to each of the pairs of FETs.

14. A microphone comprising:

a microphone unit that outputs two signals each having a phase opposite to that of the other; and an impedance converter that receives the signals from the microphone unit, and has a high input impedance and a low output impedance, wherein the impedance converter comprising:

a vacuum tube that receives an output signal from a microphone unit through a and with which the signal is output as an output from a cathode follower;

an FET in cascade connection with the vacuum tube and that defines a current flowing in the vacuum tube; and a bias circuit that applies a bias voltage to the grid of the vacuum tube, wherein the bias circuit includes a first diode and a second diode that apply the bias voltage to the grid of the vacuum tube, the first diode and the second diode being in inverse parallel connection, and a bias resistor for applying the bias voltage at a constant level to the grid of the vacuum tube via the first diode or the second diode, pairs of such vacuum tubes, FETs, and fixed bias circuits are symmetrically connected so that a balanced signal is output from two cathode followers, and an adjuster is provided between the pair of fixed bias circuits, the adjuster adjusting currents flowing in the pair of vacuum tubes to achieve a balanced output, and the adjuster connects to each of the pairs of FETs.

15. The microphone according to claim 13, wherein the microphone unit is formed of two microphone units that each output a signal having a phase opposite to that of the other microphone unit.

16. The microphone according to claim 14, wherein the microphone unit is formed of two microphone units that each output a signal having a phase opposite to that of the other microphone unit.

17. The microphone according to claim 13, wherein, with a transformer including a secondary coil with a center tap, the microphone unit outputs signals each having a phase opposite to that of the other.

18. The microphone according to claim 14, wherein, with a transformer including a secondary coil with a center tap, the microphone unit outputs signals each having a phase opposite to that of the other.

* * * * *

UNITED STATES PATENT AND TRADEMARK OFFICE

CERTIFICATE OF CORRECTION

PATENT NO. : 8,345,894 B2
APPLICATION NO. : 12/779077
DATED : January 1, 2013
INVENTOR(S) : Hiroshi Akino It is certified that error appears in the above-identified patent and that said Letters Patent is hereby corrected as shown below:

In the Specifications:

Col. 12, line 5, after "phone unit through a" insert -- grid --.

Signed and Sealed this
Twenty-fifth Day of June, 2013

Teresa Stanek Rea
*Acting Director of the United States Patent and Trademark Office*